US012674614B2

(12) United States Patent
Sperling et al.

(10) Patent No.: US 12,674,614 B2
(45) Date of Patent: Jul. 7, 2026

(54) COOLING DEVICE WITH A CONDENSER FAN AND METHOD FOR OPERATING A COOLING DEVICE WITH A CONDENSER FAN

(71) Applicant: BSH Hausgeräte GmbH, Munich (DE)

(72) Inventors: Alex Sperling, Augsburg (DE); Sebastian Wohnberger, Giengen a.d. Brenz (DE); Ming Zhang, Ulm (DE)

(73) Assignee: BSH Hausgeráte GmbH, Munich (DE)

( * ) Notice: Subject to any disclaimer, the term of this patent is extended or adjusted under 35 U.S.C. 154(b) by 97 days.

(21) Appl. No.: 18/293,879

(22) PCT Filed: Jul. 19, 2022

(86) PCT No.: PCT/EP2022/070126
§ 371 (c)(1),
(2) Date: Jan. 31, 2024

(87) PCT Pub. No.: WO2023/011910
PCT Pub. Date: Feb. 9, 2023

(65) Prior Publication Data

US 2025/0123048 A1 Apr. 17, 2025

(30) Foreign Application Priority Data

Aug. 4, 2021 (DE) ..... 10 2021 208 479.6

(51) Int. Cl.
*F25D 17/06* (2006.01)

(52) U.S. Cl.
CPC ..... *F25D 17/067* (2013.01)

(58) Field of Classification Search
CPC ..... F25D 29/00; F25B 49/027; F25B 2700/2116; F25B 2700/195; F25B 2600/111
See application file for complete search history.

(56) References Cited

U.S. PATENT DOCUMENTS 6,725,680 B1 * 4/2004 Schenk ..... F25D 29/00 62/186
8,820,101 B2 9/2014 Hausmann et al.

FOREIGN PATENT DOCUMENTS

| | | | | |
|---|---|---|---|---|
| CN | 111802868 A | * | 10/2020 | ..... A47F 3/0434 |
| DE | 102006040379 A1 | * | 3/2008 | ..... F25D 23/003 |
| EP | 1243880 A1 | | 9/2002 | |
| EP | 1942310 A2 | | 7/2008 | |
| KR | 100347895 B1 | | 8/2002 | |
| KR | 100389815 B1 | | 6/2003 | |

(Continued)

*Primary Examiner* — Ana M Vazquez
(74) *Attorney, Agent, or Firm* — Laurence A. Greenberg; Werner H. Stemer; Ralph E. Locher

(57) ABSTRACT

In a cooling device having at least one storage compartment which is accessible via a door, and also having a coolant circuit and a control unit. The coolant circuit has a compressor, a force-cooled condenser with a condenser fan, and at least one evaporator. The control unit is configured so that, in a first operating mode with a closed door, the control unit operates the condenser fan at a first rotational speed, and in a second operating mode it operates the evaporator and operates the condenser fan at a second rotational speed. The second rotational speed is substantially lower than the first rotational speed and the second operating mode begins after the door has closed.

17 Claims, 4 Drawing Sheets

(56) References Cited

FOREIGN PATENT DOCUMENTS

| | | | |
|---|---|---|---|
| WO | 2012112057 | A1 | 8/2012 |
| WO | 2017149664 | A1 | 9/2017 |

* cited by examiner

COOLING DEVICE WITH A CONDENSER FAN AND METHOD FOR OPERATING A COOLING DEVICE WITH A CONDENSER FAN

FIELD AND BACKGROUND OF THE INVENTION

The present invention relates to a refrigeration appliance, in particular to a household refrigeration appliance, with at least one storage compartment, a coolant circuit and a control unit, wherein the coolant circuit has a compressor, a forced-cooled condenser with a condenser fan and at least one evaporator.

A refrigeration appliance with a speed-controlled machine compartment fan is known from KR100347895B1.

The object of the present invention is to create a refrigeration appliance and an operating method of a refrigeration appliance with which it is possible to obtain an improvement in how frost forms on a condenser.

The object is achieved by a refrigeration appliance and a method for operating a refrigeration appliance in accordance with the independent claims.

The invention relates to a refrigeration appliance with at least one storage compartment, which is accessible via a door, a coolant circuit, and a control unit, wherein the coolant circuit has a compressor, a forced-cooled condenser with a condenser fan, and at least one evaporator, wherein the control unit is configured in such a way that the control unit, in a first mode of operation with a closed door, operates the condenser fan at a first rotational speed.

In this first operating mode a door has usually not been opened for a longer time and the storage compartments have reached their setpoint temperature. The coolant circuit is operating in the steady state and the heat load depends essentially on the ambient temperature. Accordingly the fill level of the evaporator of each storage compartment usually also depends on the heat load and thus on the ambient temperature. The first rotational speed of the condenser fan is determined by the control of the coolant circuit for reaching or for maintaining the setpoint temperature of the storage compartment or compartments.

The invention, is applicable to storage compartments and freezer compartments with all setpoint temperatures usual in household refrigeration appliances for each storage compartment and each evaporator, including compartments with moisture regulation or especially dry compartments. An evaporator can be assigned to one compartment or to a number of storage compartments in such cases.

With not very high ambient temperatures the evaporator is only partly filled with liquid coolant. The areas filled with liquid coolant essentially convey the heat out of the storage compartment. Therefore moisture essentially only precipitates in the storage compartment in these areas. This leads to an uneven frost formation on the evaporator. Thus, on the one hand the evaporator volume is not well utilized for taking up the frost and on the other hand even a small amount of frost blocks the one flow of air through the evaporator. Therefore the evaporator must be frequently defrosted.

The invention now turns to the entry of moisture into a storage compartment when a door is opened, in particular in a warm and humid climate this is the primary reason for moisture entry. In a second operating mode the control unit operates the evaporator and operates the condenser fan at a second rotational speed, which is lower than the first rotational speed, wherein the second operating mode begins after the door has been closed.

The second rotational speed is now lower that the optimum rotational speed for reaching or for obtaining the setpoint temperature of the storage compartment or compartments. The condenser thus conveys away less heat and the temperature and the pressure in the condenser rise. Due to the higher pressure more coolant gets into the evaporator and the evaporator is better filled. The better filling of the evaporator with liquid coolant brings about the desired even defrosting of the evaporator. The robustness of the refrigeration appliance is thereby improved.

The second rotational speed is significantly lower than the first rotational speed. In a preferred embodiment of the invention the second rotational speed is lower by at least 30% than the first rotational speed, especially preferably the second rotational speed is lower by at least 60% than the first rotational speed.

Both the second rotational speed and also the duration of the second operating mode can be dependent on one or more parameters, such as for example the duration of door opening, an appliance setting or the ambient temperature. Thus these parameters can be used for an optimization of the effect of the second operating mode.

The compressor is usually operated depending on an opening of a door. The invention is applicable to continuously operating compressors and intermittently operating compressors.

With intermittently operating compressors it is usual for the condenser fan to be operated at the same time as the compressor. With intermittently operating compressors an operating situation is usual in which, during an operating phase of the compressor, a door is actuated, and the compressor continues to be operated during the door actuation and also thereafter, thus the door actuation falls within a period of compressor operation. That is the primary application case of the invention.

If during the door opening or after the door closing a new period of running the compressor starts, then the rotational speeds of the compressor and of the condenser fan can be initialized again for this according to the compartment temperature requirements. This then corresponds to the first operating mode. Also in this case, in accordance with the invention, after a door closure, a second operating mode is applied and during this second operating mode the condenser fan is not operated or is operated at a reduced rotational speed compared to the initialized rotational speed of the condenser fan.

During the door opening the condenser fan can be operated or not operated. The condenser fan can be not operated or operated at reduced rotational speed during the door opening with the advantage of better support for the invention and less noise.

During the door opening a fan for circulating the air in the storage compartment is advantageously not operated or is operated at lower rotational speed, with the advantages of an avoidance of simultaneous entry of moisture into the refrigeration appliance and into the evaporator and less noise.

In accordance with an embodiment of the invention the refrigeration appliance has a number of compartments with a different setpoint temperature and a door each and the control unit is configured in such a way that the second rotational speed and/or a duration of the second operating mode of the compartment depend on the door closure.

In this way on the one hand the invention can be applied to different compartments or different doors. In the second operating mode the control unit operates the evaporator of the compartment of which the door has been actuated or closed and operates the condenser fan at a second rotational speed, which is less than the first rotational speed before the opening of the door.

On the other hand this embodiment makes it possible to design the second operating mode differently for different compartments, namely to set the second rotational speed and/or the duration of the second operating mode depending on the size and the type of the compartment and the door actuation.

An especially simple embodiment for a fridge-freezer combination appliance makes provision for the same second operating mode both on actuation of the refrigerator compartment door and also on actuation of the freezer compartment door.

In accordance with one embodiment of the invention the evaporator is a fin evaporator. The fan for circulating the air in the storage compartment can be arranged in an evaporator unit or at another location in an air duct.

In accordance with one embodiment of the invention the condenser has a temperature sensor or a pressure sensor. Both a temperature sensor and also a pressure sensor make it possible on the one hand to observe the pressure in the condenser and to check the effectiveness of the condenser fan at the second rotational speed and where necessary to adjust the duration and/or the second rotational speed. Both a temperature sensor and also a pressure sensor make it possible on the other hand to detect when limit values for pressure and temperature have been reached or exceeded.

In accordance with one embodiment of the invention the control unit is configured to determine the second rotational speed and/or a duration of the second operating mode depending on measured values of the temperature sensor and/or pressure sensor. On detection of permitted limit values for pressure and temperature having been reached or exceeded it is in the interest of appliance safety to end the second operating mode.

The condenser is preferably a MCHE (Multi Channel Extruded) type condenser or wire tube condenser.

The inventive method for operating a refrigeration appliance with at least one storage compartment, which is accessible via a door, and a coolant circuit, wherein the coolant circuit has a compressor, a forced-air cooled condenser with a condenser fan, and at least one evaporator, contains the method steps of, a) in a first operating mode with a closed door, operating the condenser fan at a first rotational speed;

b) determining that a door is being closed;

c) in a second operating mode, after determining that the door has been closed, operating the evaporator and operating the condenser fan at a second rotational speed that is substantially lower than the first rotational speed.

Between method steps a) and b) a door actuation, a door opening, and subsequent door closure are performed, which is detected by means of a door switch.

In accordance with an embodiment of the method, when it is determined that a door has been closed, in the further method step b1), the condenser fan is switched off; this corresponds to a second rotational speed of zero. This significantly reduces an emission of heat from the condenser.

In accordance with one embodiment of the method, in the second operating mode in the further method step c1) the compressor is operated. In this step further coolant is supplied to the condenser, which gives off its evaporation heat in the condenser.

The inflow of heat into the condenser and the reduced outflow of heat from the condenser bring about an increased pressure in the condenser, as a consequence of which more liquid coolant gets into the evaporator operated in the second operating mode, whereby the filling of the evaporator with liquid coolant increases.

In accordance with one embodiment of the method, in the second operating mode in the further method step c2) there is a slow startup or step-by-step startup of the rotational speed of the condenser fan. This brings about a slow or step-by-step increase in the outflow of heat from the condenser. The moisture introduced into the storage compartment when the door is opened is now transported by means of the condenser fan into the evaporator. Due to the good filling of the evaporator, the coolant evaporates over a large length of the evaporator tube. In the area of this large length the moist air is condensed around the evaporator tube and on the neighboring fins. With evaporator temperatures below 0° C., the condensation occurs as formation of frost. On account of the large length over which the evaporation takes place the formation of frost is distributed very evenly in the evaporator volume.

In accordance with one embodiment of the method, in the second operating mode in the further method step c3) there is delayed buildup of the rotational speed of the condenser fan by a predetermined delay time. The delayed increase in the rotational speed of the condenser fan brings about a much low outflow of heat from the condenser for the duration of the delay. This allows the desired increased filling of the evaporator to be improved and to be influenced with regard to the additional amount of coolant.

In accordance with one embodiment of the method, in the second operating mode in the further method step c3) the second operating mode is ended after a predetermined duration. Thus, after an estimated end of the dehumidifying of the storage space after the door is closed, there can be an immediate transition to normal cooling operation in the first operating mode.

In accordance with an embodiment of the method, in the second operating mode in the further method step c4) the second operating mode is ended when a predetermined temperature or a predetermined pressure of the condenser is reached. This makes it possible to guard against too high a temperature or too high a pressure in the condenser.

After the end of the second operating mode the normal operation of the refrigeration appliance is continued with a first new operating mode. The fan rotational speed of the first operating mode can be identical to that of the first operating mode. However it is also possible for the operating situation to change in the meantime, which leads to a change in the fan rotational speed, for example when, in conjunction with the opening of a door, warm items have been brought into the storage space or when the user has changed the temperature setting of a compartment.

BRIEF DESCRIPTION OF THE FIGURES

Further features and advantages of the invention emerge from the description of exemplary embodiments given below, which relate to the enclosed figures. In the drawings.

DETAILED DESCRIPTION OF THE INVENTION

Figure 1:
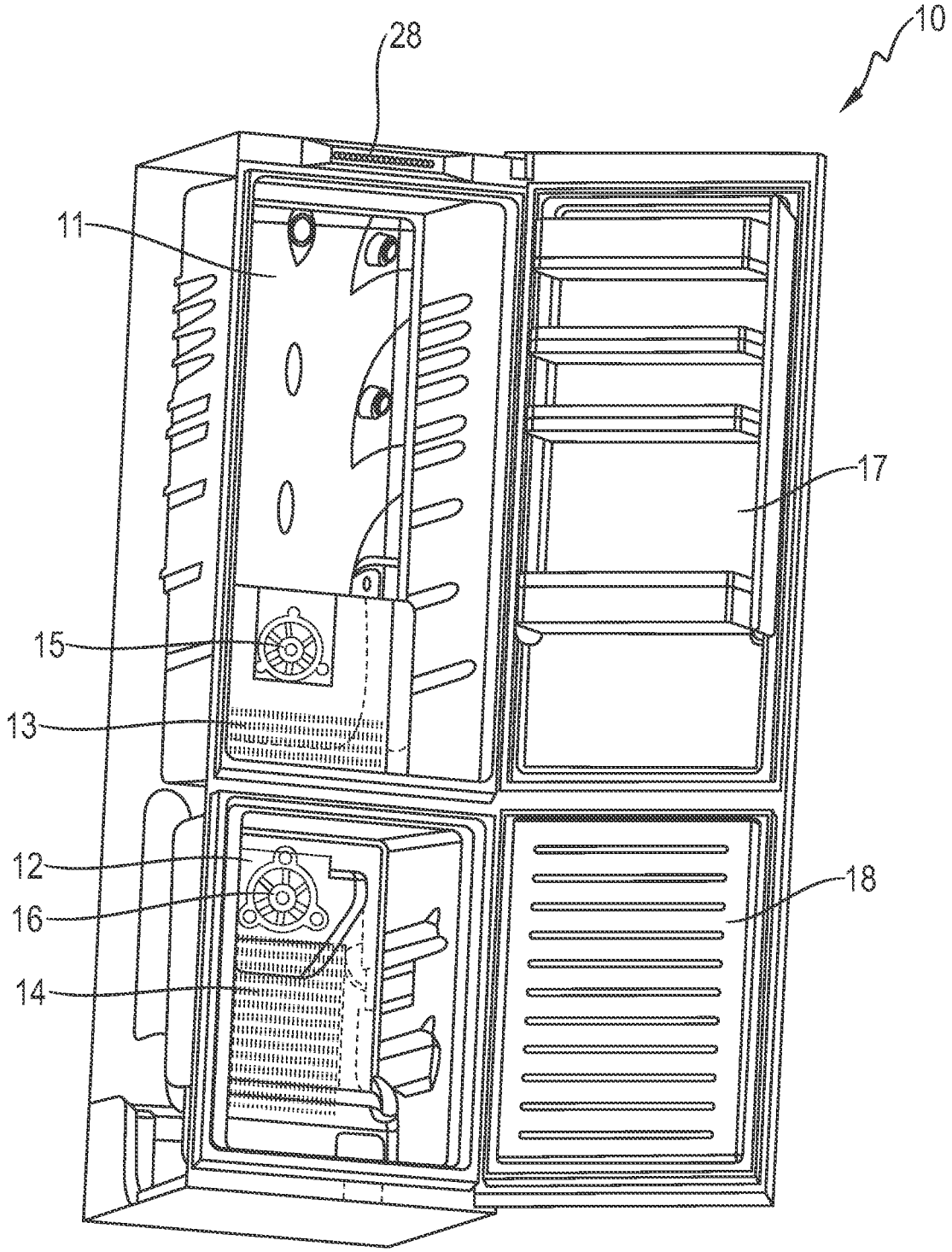
FIG. 1 shows a schematic diagram of an inventive refrigeration appliance.

FIG. 1 shows a schematic diagram of a refrigeration appliance 10 in accordance with the invention with a spatial arrangement of components, viewed from the front side of the appliance. The insulation material and the walls of the storage compartments are not shown in the drawing.

Figure 2:
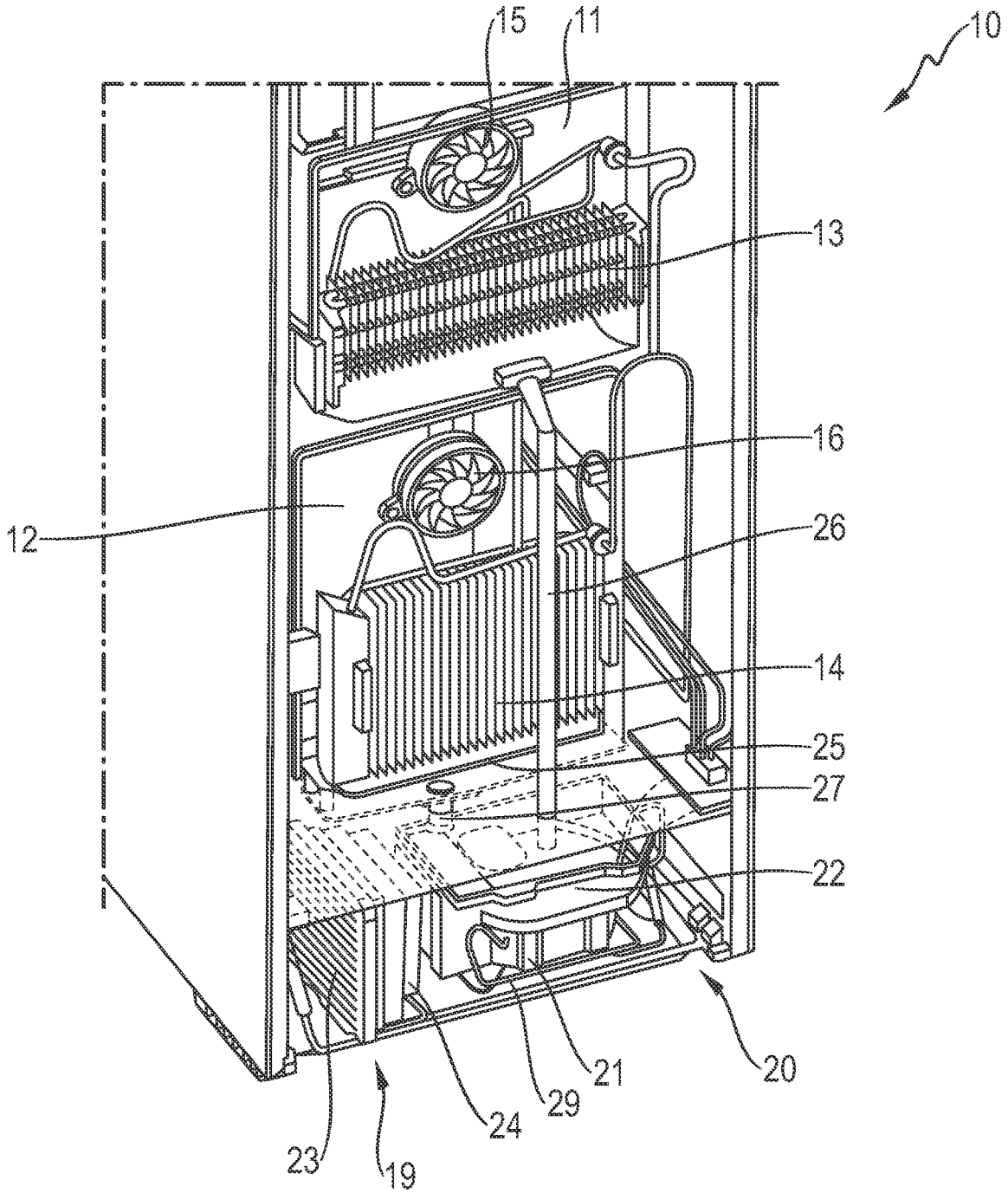
FIG. 2 shows a schematic diagram with a number of components of the inventive refrigeration appliance.

FIG. 2 shows a schematic section of the refrigeration appliance 10 with a spatial arrangement of components, viewed from the rear side of the appliance. The rear panel, the insulation material and the walls of the storage compartments are not shown in the drawing.

The refrigeration appliance 10 has a first storage compartment 11 as a refrigeration compartment and a second storage compartment 12 as a freezer compartment. Each of the storage compartments 11, 12 is cooled by an evaporator 13, 14, here a fin evaporator in each case. The fin evaporators are each forced-air cooled with a compartment fan 15, 16, which brings about a circulation of air between storage compartment and evaporator and with the storage compartment. The associated air ducts are not shown in the drawing. Each storage compartment 11, 12 is accessible via a door 17, 18.

A machine compartment 20 is located in the lower rear area of the refrigeration appliance 10, in which components are arranged outside of the thermal insulation. In particular the machine compartment has a compressor 21, an evaporation tray 22, arranged thereon and a forced-cooled condenser 23 with a condenser fan 24. Further components in the machine compartment such as valves, dryers and tubular pipes are not shown.

The evaporator 14 of the freezer compartment, storage compartment 12, has a defrosting heater 25. Condensation water or defrost water of the evaporator 13, 14 is conveyed away by drainage lines 26, 27 into the evaporation tray 22.

A control unit 28, which controls a coolant circuit 29 and the compartment fans, is located in a front panel of the refrigeration appliance 10.

The compressor 21, the condenser 23 with the condenser fan 24, and the evaporator 13, 14 belong to the coolant circuit 29, of which only a few components are shown. The control of the compressor 21 and of valves for reaching and maintaining temperatures in the storage compartments 11, 12 is not discussed here.

With regard to the control of the refrigeration appliance the invention makes a distinction between two modes of operation. The first operating mode comprises control of the refrigeration appliance as is known from the prior art and is usual in order to achieve and to maintain the compartment temperatures. The second operating mode comprises control of the refrigeration appliance modified in accordance with the invention, which is triggered due to a door being opened. In this case, with regard to the aim of the invention, the typical case is assumed in which a significant amount of moisture is introduced into a storage compartment when a door is opened. Since the entry both of heat and also of moisture into a storage compartment ends with the closing of the door of a storage compartment, the beginning of the second operating mode is started as from this second point in time. From this point in time onwards operation of the compressor and of the condenser fan is sensible in any event.

The period of time of the door actuation from the door opening until the door closure is not assigned to any of the operating modes, since depending on refrigeration appliance, the first operating mode is present or not present in this period of time. The person skilled in the art is not prevented from operating the refrigeration appliance in the second operating mode in this period of time.

The invention is explained starting from a refrigeration appliance 10 with the coolant circuit 29 in the steady state, on the basis of the door 17 of the refrigeration compartment being opened, wherein the refrigeration compartment 17 is assumed to be just active. The temperatures of the storage compartments 11, 12 are reached and are being maintained, evaporator temperatures, evaporator fillings with coolant, fan rotational speeds and compressor rotational speed are set accordingly by the control unit 28. In particular, in the first operating mode of the condenser fan, it is operated at a first rotational speed. The evaporator 11 of the active cooling compartment is only partly filled with coolant, since a maximum heat load is not present.

If it is now determined that the door 17 has been closed, then the control unit operates the condenser fan in a second operating mode at a second rotational speed that is less than a first rotational speed. The condenser now emits less heat and the temperature and the pressure in the condenser rise.

Due to the higher pressure more coolant gets into the first evaporator 11 of the active cooling compartment and the evaporator 11 is better filled. The better filling of the evaporator with liquid coolant brings about the desired even defrosting of the evaporator.

The condenser 23 has a temperature sensor 19 or a pressure sensor. Each of these sensor types makes it possible to observe the temperature and the pressure in the condenser while gaseous coolant is condensing in the condenser.

The control unit 28 is configured to determine the second rotational speed and/or a duration of the second operating mode depending on measured values of the temperature sensor 19 or pressure sensor.

The invention is applicable to refrigeration appliances with a number of storage compartments with a different setpoint temperature in different forms of embodiment. The person skilled in the art can generalize the following forms of embodiment for two storage compartments to further storage compartments and doors.

The refrigeration appliance 10 has two storage compartments 11, 12 with a door 17, 18 in each case. The control unit 28 can be configured in such a way that the second rotational speed and/or a duration of the second operating mode of the compartment depends on the closing of the door.

In one simple form of embodiment the second operating mode is carried out after each door actuation or closure of one of the doors 17, 18. Thus the compartment operated in the first operating mode before the door opening is given a second operating mode.

In a further form of embodiment the second operating mode is carried out after each door actuation or closure of one of the doors 17, 18 with the next operation of this storage compartment. Thus the compartment operated in the first operating mode before the door opening is immediately given a second operating mode, provided it continues to be operated after the door closure. If the door of the other storage compartment not operated in the first operating mode has been actuated or closed, then this storage compartment is given a second operating mode as soon as it is operated again after a change of compartment. Thus the compartment of the door opening is reliably given a second operating mode with the next compressor run assigned to it and the moisture introduced into the compartment during the door actuation is advantageously taken up distributed over the entire evaporator.

Figure 3:
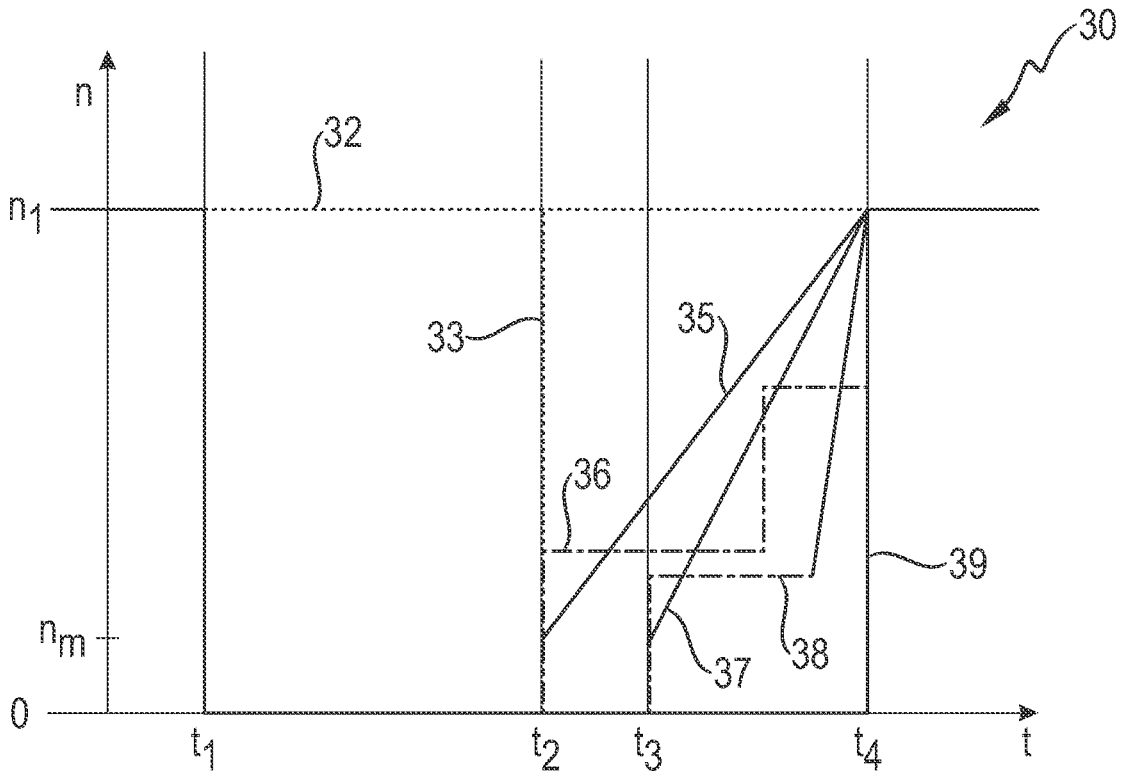
FIG. 3 shows a schematic diagram of rotational speed graphs of an inventive refrigeration appliance.

FIG. 3 shows, in a diagram 30, schematic examples of rotational speed graphs of various forms of embodiment of the invention, which can be realized in the control unit 28 and also in the inventive method.

The abscissa of the diagram 30 forms a time axis t with points in time with a given value 0 and points in time $t_1$, $t_2$, $t_3$, $t_4$. The ordinate forms a rotational speed axis n with rotational speeds of the condenser fan with a given value 0 and rotational speeds $n_m$, $n_1$.

The points in time $t_1$, $t_2$, $t_3$, $t_4$ refer, in this order, to the end of the first operating mode, i.e. to the beginning of the door opening, to the beginning of the second operating mode, i.e. the door closure, to the point in time of a delay and to the end of the second operating mode.

The rotational speeds $n_m$, $n_1$ refer to a minimum fan rotation speed and to the fan rotation speed in the first operating mode.

Diagram 30 shows a number of rotational speed graphs, of which sections can be identical. What is common to all rotational speed graphs is the rotational speed $n_1$ during the first operating phase and after point in time $t_4$.

The rotational speed graph 32 according to the prior art describes a continuous constant rotational speed. The rotational speed graph 33 according to the prior art represents a continuous constant rotational speed before the door opening at $t_1$ and after the door closure as from $t_2$, wherein the fan is switched off during the door opening.

The rotational speed graphs in accordance with the invention all run at the rotational speed $n_1$ of the first operating mode up to the door opening and after the end of the second operating mode in $t_4$, and with the fan switched off during the door opening. The effect of the invention is supported if the condenser fan is switched off during the door opening. The rotational speed graphs differ in the second operating phase between $t_2$ and $t_4$.

The rotational speed graph 35 begins the second operating mode in $t_2$ with the minimum fan rotational speed $n_m$ and then increases continuously until it reaches $n_1$ at the end of the second operating mode and in $t_4$ is continued there as the first operating mode.

The rotational speed graph 36 begins the second operating mode with a medium fan rotational speed between $n_m$ and $n_1$ and runs in steps until the end of the second operating mode at $t_4$, where it is continued with $n_1$ as a further operating mode.

The rotational speed graphs 37 and 38 begin the second operating mode with condenser fan switched off, which is switched on with a delay in $t_3$. From this point in time onwards the form of the rotational speed graphs 37 corresponds to the rotational speed graph 35. The rotational speed graph 38 is an example of mixed mode up of rotational speed graphs 35 and 36. After delayed switching on of the condenser fan in $t_3$ the condenser fan initially runs at a constant rotational speed and is then continuously increased to the rotational speed $n_1$.

In the rotational speed graph 39 the condenser fan is switched off during the entire second operating mode.

Figure 4:
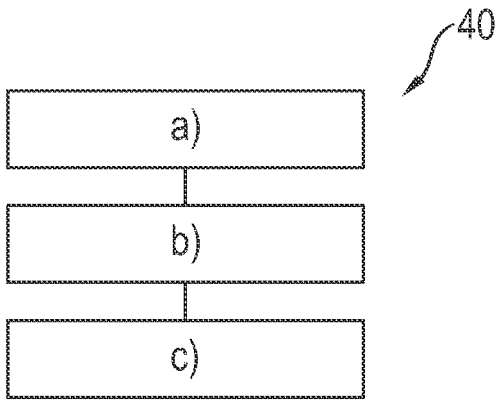
FIG. 4 shows a flow diagram of a form of embodiment of the inventive method.

FIG. 4 shows a flow diagram 40 of a form of embodiment of the inventive method. The method begins in a first operating mode with a closed door with method step a) operating the condenser fan at a first rotational speed. There follows method step b) determining a door closure. After the door closure has been determined, this is followed in method step c), in a second operating mode, by operating the condenser fan at a second rotational speed, which is lower than the first rotational speed.

Figure 5:
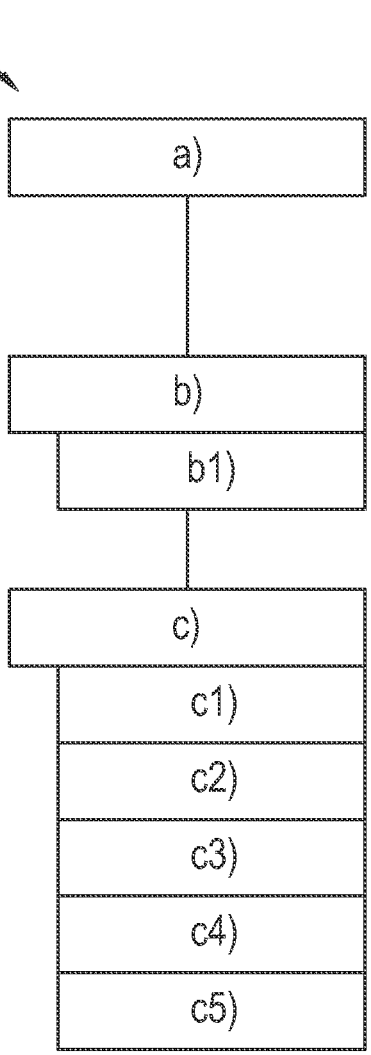
FIG. 5 shows a flow diagram of a further form of embodiment with embodiments of the inventive method.

FIG. 5 shows a flow diagram 50 with further forms of embodiment of the inventive method. The method begins in a first operating mode with a closed door with method step a) operating the condenser fan at a first rotational speed.

This is followed by a method step b) determining a door closure. Before or on determination of the door closure there is the further method step b1) switching off the condenser fan.

After determination of the door closure there follows method step c) Operation of the condenser fan in a second operating mode at a second rotational speed that is lower than the first rotational speed. Within the second operating mode the following further method steps are possible independently of one another:

c1) operating the compressor;

c2) slowly increasing the rotational speed or increasing the rotational speed of the condenser fan on a step-by-step basis;

c3) increasing the rotational speed of the condenser fan with a delay by a predetermined delay time;

c4) ending the second operating mode after a predetermined time; and c5) ending the second operating mode on reaching a predetermined temperature or a predetermined pressure of the condenser.

With the operation of the compressor, condensation heat is conveyed to the condenser in the second operating mode. The slow increase in rotational speed and the delayed increase in rotational speed bring about an increased pressure increase effect in the condenser at the beginning of the second operating mode, with increasing appliance efficiency during the second operating mode. The ending of the second operating mode after a predetermined time makes possible a return to normal efficient cooling operation after the moisture introduced into the storage space has precipitated in the evaporator. A suitable duration can be determined during the device development. The ending of the second operating mode on reaching a predetermined temperature or a predetermined pressure of the condenser represents a safety function.

LIST OF REFERENCE CHARACTERS

10 Refrigeration appliance
11 First storage compartment
12 Second storage compartment
13, 14 Evaporator
15, 16 Compartment fan
17, 18 Door
19 Temperature sensor
20 Machine compartment
21 Compressor
22 Evaporation tray
23 Condenser
24 Condenser fan
25 Defrost heating
26, 27 Drainage line
28 Control unit
29 Coolant circuit
30 Diagram
32, 33 Rotational speed graph
35-39 Rotational speed graph
40 Flow diagram
50 Flow diagram

The invention claimed is:

1. A refrigeration appliance, comprising:

at least one storage compartment which is accessible via a door;

a coolant circuit having a compressor, a forced draft air cooled condenser with a condenser fan, and at least one evaporator;

a control unit configured:

in a first operating mode with the door closed, to drive said condenser fan at a first rotational speed; and in a second operating mode, to operate said evaporator and to drive said condenser fan at a second rotational speed that is significantly lower than the first rotational speed; and wherein the second operating mode begins when, after the door has been opened, the control unit has determined that the door has been closed.

2. The refrigeration appliance according to claim 1, wherein said at least one storage compartment is one of a plurality of storage compartments, each with a different setpoint temperature and a door, and said control unit is configured such that at least one of the second rotational speed or a duration of the second operating mode of said storage compartment depends on the closure of the respective door.

3. The refrigeration appliance according to claim 2, wherein said control unit is configured to start the second operating mode for a given duration when any given one of the doors has been closed.

4. The refrigeration appliance according to claim 2, wherein said evaporator is a fin evaporator.

5. The refrigeration appliance according to claim 2, wherein a compartment fan is assigned to a respective evaporator.

6. The refrigeration appliance according to claim 2, wherein said condenser is a multi-channel-extruded type condenser or a wire tube condenser.

7. A method of operating a refrigeration appliance with at least one storage compartment, which is accessible via a door, and a coolant circuit having a compressor, a forced draft air cooled condenser with a condenser fan, and at least one evaporator, the method comprising the following steps:

a) in a first operating mode with a closed door, operating the condenser fan at a first rotational speed;

b) determining a door closure;

c) in a second operating mode, based on the door closure having been determined, operating the evaporator and driving the condenser fan at a second rotational speed that is lower than the first rotational speed.

8. The method according to claim 7, wherein the second rotational speed is lower than the first rotational speed by at least 30%.

9. The method according to claim 8, wherein the second rotational speed is lower than the first rotational speed by at least 60%.

10. The method according to claim 7, wherein the second operating mode has a predetermined duration.

11. The method according to claim 7, which comprises, upon detecting the door closure, b1) switching off the condenser fan.

12. The method according to claim 7, which comprises, as a further method step in the second operating mode, c1) operating the compressor.

13. The method according to claim 7, which comprises, as a further method step in the second operating mode, c2) slowly increasing the rotational speed of the condenser fan or increasing the rotational speed of the condenser fan on a step-by-step basis.

14. The method according to claim 7, which comprises, as a further method step in the second operating mode, c3) increasing the rotational speed of the condenser fan with a delay by a predetermined delay time.

15. The method according to claim 7, which comprises, as a further method step in the second operating mode, c4) ending the second operating mode after a predetermined time.

16. The method according to claim 7, which comprises, as a further method step in the second operating mode, c5) ending the second operating mode on reaching a predetermined temperature or a predetermined pressure of the condenser.

17. The method according to claim 7, which comprises, selectively performing any of the following further method steps in the second operating mode, c1) operating the compressor;

c2) slowly increasing the rotational speed of the condenser fan or increasing the rotational speed of the condenser fan on a step-by-step basis;

c3) increasing the rotational speed of the condenser fan with a delay by a predetermined delay time;

c4) ending the second operating mode after a predetermined time; or c5) ending the second operating mode on reaching a predetermined temperature or a predetermined pressure of the condenser.

* * * * *